US007627257B2

(12) United States Patent
Clarke et al.

(10) Patent No.: US 7,627,257 B2
(45) Date of Patent: Dec. 1, 2009

(54) METHOD FOR ASSOCIATING A CUSTOMER ACCESSIBLE SUPPLY ITEM WITH AN IMAGING APPARATUS

(75) Inventors: Cyrus Bradford Clarke, Lexington, KY (US); William Paul Cook, Lexington, KY (US); Steven Wayne Parish, Lexington, KY (US); William Shannon Spencer, Georgetown, KY (US); Peter Eric Wallin, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 519 days.

(21) Appl. No.: 11/467,300

(22) Filed: Aug. 25, 2006

(65) Prior Publication Data

US 2008/0050129 A1 Feb. 28, 2008

(51) Int. Cl.
*G03G 15/00* (2006.01)

(52) U.S. Cl. ..... 399/12

(58) Field of Classification Search ..... 399/11, 399/12, 13, 24–27, 31, 33, 34, 36, 111; 347/86
See application file for complete search history.

(56) References Cited

U.S. PATENT DOCUMENTS 5,132,729 A * 7/1992 Matsushita et al. ..... 399/24
5,579,088 A * 11/1996 Ko ..... 399/12
5,807,005 A * 9/1998 Wright ..... 400/668
5,995,774 A * 11/1999 Applegate et al. ..... 399/27
6,408,141 B1 * 6/2002 Tahara ..... 399/12
7,050,726 B2 5/2006 Adkins
7,088,928 B2 * 8/2006 Burchette et al. ..... 399/12
7,286,774 B1 * 10/2007 Miller et al. ..... 399/12
2007/0154228 A1 * 7/2007 Chan ..... 399/12
2008/0212128 A1 * 9/2008 Cha ..... 358/1.15

FOREIGN PATENT DOCUMENTS

JP 2002149019 A * 5/2002
JP 2002331728 A * 11/2002

* cited by examiner

*Primary Examiner*—Robert Beatty
(74) *Attorney, Agent, or Firm*—Ronald K. Aust; John Victor Pezdek

(57) ABSTRACT

A method for associating a customer accessible supply item of a first type with an imaging apparatus includes communicating identification information between the customer accessible supply item of the first type and the imaging apparatus; and operationally locking the customer accessible supply item of the first type with only the imaging apparatus based on the identification information, to the exclusion of other imaging apparatuses and other customer accessible supply items of the first type.

18 Claims, 4 Drawing Sheets

METHOD FOR ASSOCIATING A CUSTOMER ACCESSIBLE SUPPLY ITEM WITH AN IMAGING APPARATUS

CROSS REFERENCES TO RELATED APPLICATIONS

None.

STATEMENT REGARDING FEDERALLY SPONSORED RESEARCH OR DEVELOPMENT

None.

REFERENCE TO SEQUENTIAL LISTING, ETC.

None.

BACKGROUND

1. Field of the Invention

The present invention relates generally to an imaging apparatus and customer accessible supply item, and more particularly to a method for associating a customer accessible supply item with an imaging apparatus.

2. Description of the Related Art

In prior art, an imaging apparatus is used to form an image on a print medium, such as paper, transparency, fabric, etc. The imaging apparatus may be, for example, a printer, a copier or a multifunction machine. Such an imaging apparatus includes a print engine for forming the image on the print medium. For example, an ink jet printer has an ink jet print engine for ejecting ink drops onto a print medium, and an electrophotographic (e.g., laser) printer has an electrophotographic (EP) print engine for applying toner to a print medium. Such a multifunction machine may include an ink jet print engine and/or an EP print engine, and is configured to perform stand alone functions, such as copying or facsimile receipt and transmission, or may be connected to a host via a communications link to facilitate a printing function.

A customer accessible supply item is a component used in or in association with the imaging apparatus that is depleted over time, and to which a customer has access for replacement or adjustment purposes. One type of customer accessible supply item, for example, is an imaging cartridge. An imaging cartridge is a replaceable cartridge configured for use in forming images on a print medium. Such an imaging cartridge may be, for example, a toner cartridge containing toner, a photoconductive drum, a toner cartridge/photoconductive drum combination, an ink cartridge containing ink, or an ink jet printhead cartridge containing ink and having an integral printhead. Other types of customer accessible supply items include, for example, a drive belt, a transport belt, a photoconductive belt, a print media supply tray, a fuser assembly, etc.

SUMMARY OF THE INVENTION

The invention, in one form thereof, is directed to a method for associating a customer accessible supply item of a first type with an imaging apparatus. The method includes communicating identification information between the customer accessible supply item of the first type and the imaging apparatus; and operationally locking the customer accessible supply item of the first type with only the imaging apparatus based on the identification information, to the exclusion of other imaging apparatuses and other customer accessible supply items of the first type.

The invention, another form thereof, is directed to a method for associating a customer accessible supply item of a first type with an imaging apparatus. The method includes communicating identification information between the customer accessible supply item of the first type and the imaging apparatus; and determining whether the customer accessible supply item of the first type is operationally locked with the imaging apparatus based on an interrogation of the identification information, wherein the state of being operationally locked is a non-mechanical exclusive union of the customer accessible supply item of the first type with the imaging apparatus.

The invention, in still another form thereof, is directed to a method for associating a customer accessible supply item of a first type with an imaging apparatus, wherein the imaging apparatus has a first memory having stored therein imaging apparatus identification information and the customer accessible supply item of the first type has a second memory having stored therein supply item identification information. The method includes operationally locking the customer accessible supply item of the first type with only the imaging apparatus based on the imaging apparatus identification information and the supply item identification information, wherein a state of being operationally locked is a non-mechanical exclusive union of the customer accessible supply item of the first type with the imaging apparatus.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

DETAILED DESCRIPTION

Figure 1:
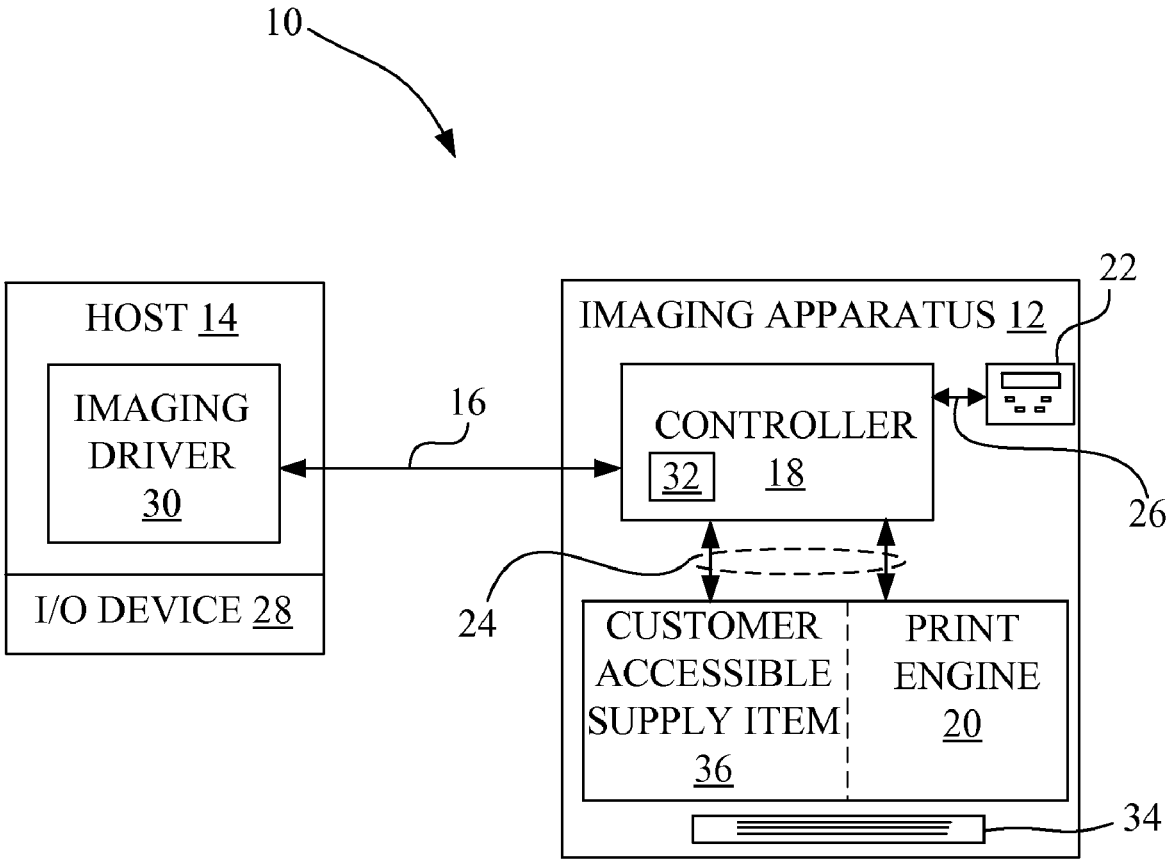
FIG. 1 is a diagrammatic representation of an exemplary imaging system embodying the present invention.

It is to be understood that the invention is not limited in its application to the details of construction and the arrangement of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

In addition, it should be understood that embodiments of the invention include both hardware and electronic components or modules that, for purposes of discussion, may be illustrated and described as if the majority of the components were implemented solely in hardware. However, one of ordinary skill in the art, and based on a reading of this detailed description, would recognize that, in at least one embodiment, the electronic based aspects of the invention may be implemented in software. As such, it should be noted that a plurality of hardware and software-based devices, as well as a plurality of different structural components may be utilized to implement the invention. Furthermore, and as described in subsequent paragraphs, the specific mechanical configurations illustrated in the drawings are intended to exemplify embodiments of the invention and that other alternative mechanical configurations are possible.

Referring now to the drawings and particularly to FIG. 1, there is shown a diagrammatic depiction of an imaging system 10 embodying the present invention. Imaging system 10 includes an imaging apparatus 12 and a host 14, which may be optional. As used herein, the term "imaging apparatus" means an apparatus used to form an image on a print medium, such as paper, transparency, fabric, etc., and may utilize, for example, one or more of the following exemplary print technologies: ink jet, dot matrix, dye sublimation, electro photographic (e.g., laser), etc.

Imaging apparatus 12 communicates with host 14 via a communications link 16. As used herein, the term "communications link" is used to generally refer to structure that facilitates electronic communication between multiple components, and may operate using wired or wireless technology. Communications link 16, for example, may be established by a direct cable connection, wireless connection or by a network connection such as for example an Ethernet local area network (LAN).

Imaging apparatus 12 may be, for example, a printer and/or copier, or an all-in-one (AIO) unit that includes a print engine, a scanner unit, and possibly a fax unit that incorporate multiple functions such as scanning, copying, and printing capabilities in one device. An AIO unit is also known in the art as a multifunction machine. In the example shown in FIG. 1, imaging apparatus 12 includes a controller 18, a print engine 20, and a user interface 22. Print engine 20 may utilize electrophotographic (e.g., laser) technology, ink jet technology, or other suitable printing technology consistent with this disclosure. Imaging apparatus 12 may communicate with host 14 via a standard communication protocol, such as for example, universal serial bus (USB), Ethernet or IEEE 812.1x.

In the present embodiment, controller 18 communicates with print engine 20 via a communications link 24. Controller 18 communicates with user interface 22 via a communications link 26. Communications links 24 and 26 may be established, for example, by using standard electrical cabling or bus structures, or by wireless connection.

Host 14 may be, for example, a personal computer including an input/output (I/O) device 28, such as keyboard and display monitor. Host 14 further includes a processor, input/output (I/O) interfaces, memory, such as RAM, ROM, NVRAM, and a mass data storage device, such as a hard drive, CD-ROM and/or DVD units. During operation, host 14 includes in its memory a software program including program instructions that function as an imaging driver 30, e.g., printer driver software, for imaging apparatus 12. Imaging driver 30 is in communication with controller 18 of imaging apparatus 12 via communications link 16. Imaging driver 30 facilitates communication between imaging apparatus 12 and host 14, and may provide print data to imaging apparatus 12, and more particularly, to print engine 20.

Alternatively, however, all or a portion of imaging driver 30 may be located in controller 18 of imaging apparatus 12. For example, in embodiments where imaging apparatus 12 is a multifunction machine having standalone capabilities, controller 18 of imaging apparatus 12 may include an imaging driver configured to support a copying function, and/or a fax-print function, and may be further configured to support a printer function. For example, the imaging driver may facilitate communication of print data, as determined by a selected print mode, to print engine 20.

Controller 18 includes a processor unit and an associated memory 32, and may be formed as one or more Application Specific Integrated Circuits (ASIC). Memory 32 may include, for example, random access memory (RAM), read only memory (ROM), and/or non-volatile RAM (NVRAM). Memory 32 may be formed as part of the ASIC of controller 18, or alternatively may be a separate electronic memory (e.g., RAM, ROM, and/or NVRAM), a hard drive, a CD or DVD drive, or any memory device convenient for use with controller 18. Controller 18 serves to process print data and other information, and to operate print engine 20 during printing of an image on a print medium 34, such as a sheet of paper, transparency, etc.

Also shown in FIG. 1 is a customer accessible supply item 36 mounted to imaging apparatus 12. As used herein, the term "customer accessible supply item" means a component used in or in association with the imaging apparatus that is usually depleted (e.g., used up or worn out) over time, and to which a customer has access for replacement if worn out or broken or for adjustment purposes. In the present embodiment, controller 18 communicates with customer accessible supply item 36 via a communications link 24, and such communication may be unidirectional or bidirectional, depending on the implementation.

Figure 2:
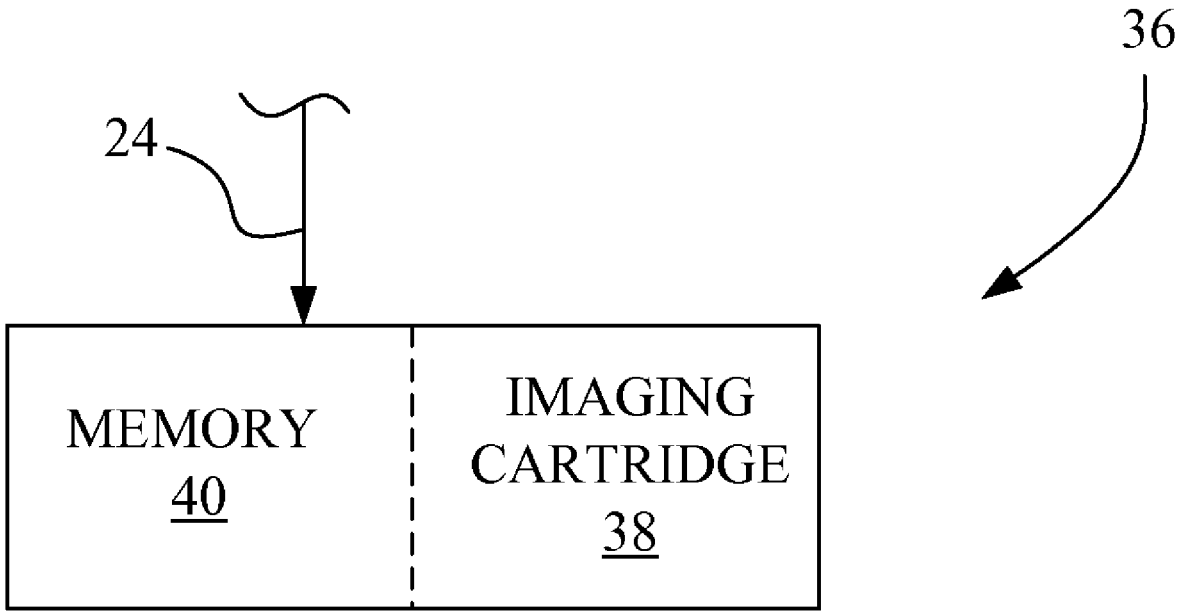
FIG. 2 is a diagrammatic representation of one embodiment of a customer accessible supply item for use in the imaging system of FIG. 1.

FIG. 2 is a diagrammatic illustration of an exemplary embodiment of customer accessible supply item 36. In this embodiment, for example, customer accessible supply item 36 is an imaging cartridge 38 having a memory 40. As used herein, an imaging cartridge is a replaceable cartridge configured for use in forming images on a print medium. Examples of imaging cartridge 38 include, but are not limited to, for example, a toner cartridge containing toner, a photoconductive drum, a toner cartridge/photoconductive drum combination, an ink cartridge containing ink, or an ink jet printhead cartridge containing ink and having an integral printhead. Other types of customer accessible supply items include, for example, a drive belt, a transport belt, a photoconductive belt, a print media supply tray, a fusing assembly, etc.

In the present embodiment, controller 18 communicates with imaging cartridge 38, and in particular memory 40, via communications link 24. Memory 40 may be formed integral with a component of imaging cartridge 38, or may be attached to, e.g., a housing of, imaging cartridge 38. Memory 40 includes semi-conductor memory, e.g., NVRAM, RAM, ROM, etc., and associated interface electronics.

Figure 3:
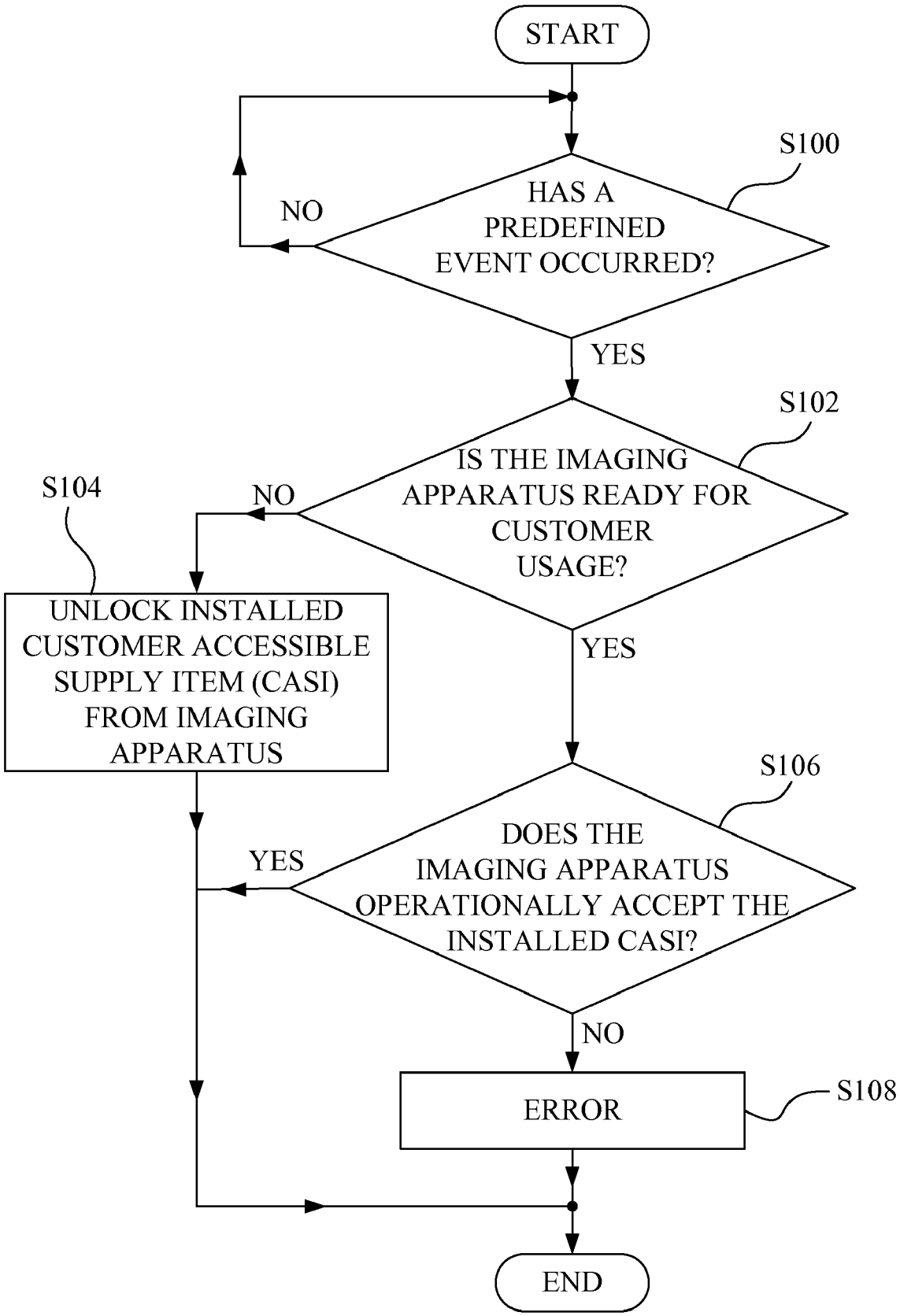
FIGS. 3 and 4 are flowcharts depicting of a method for associating a customer accessible supply item of a first type with an imaging apparatus in accordance with an embodiment of the present invention.
Figure 4:
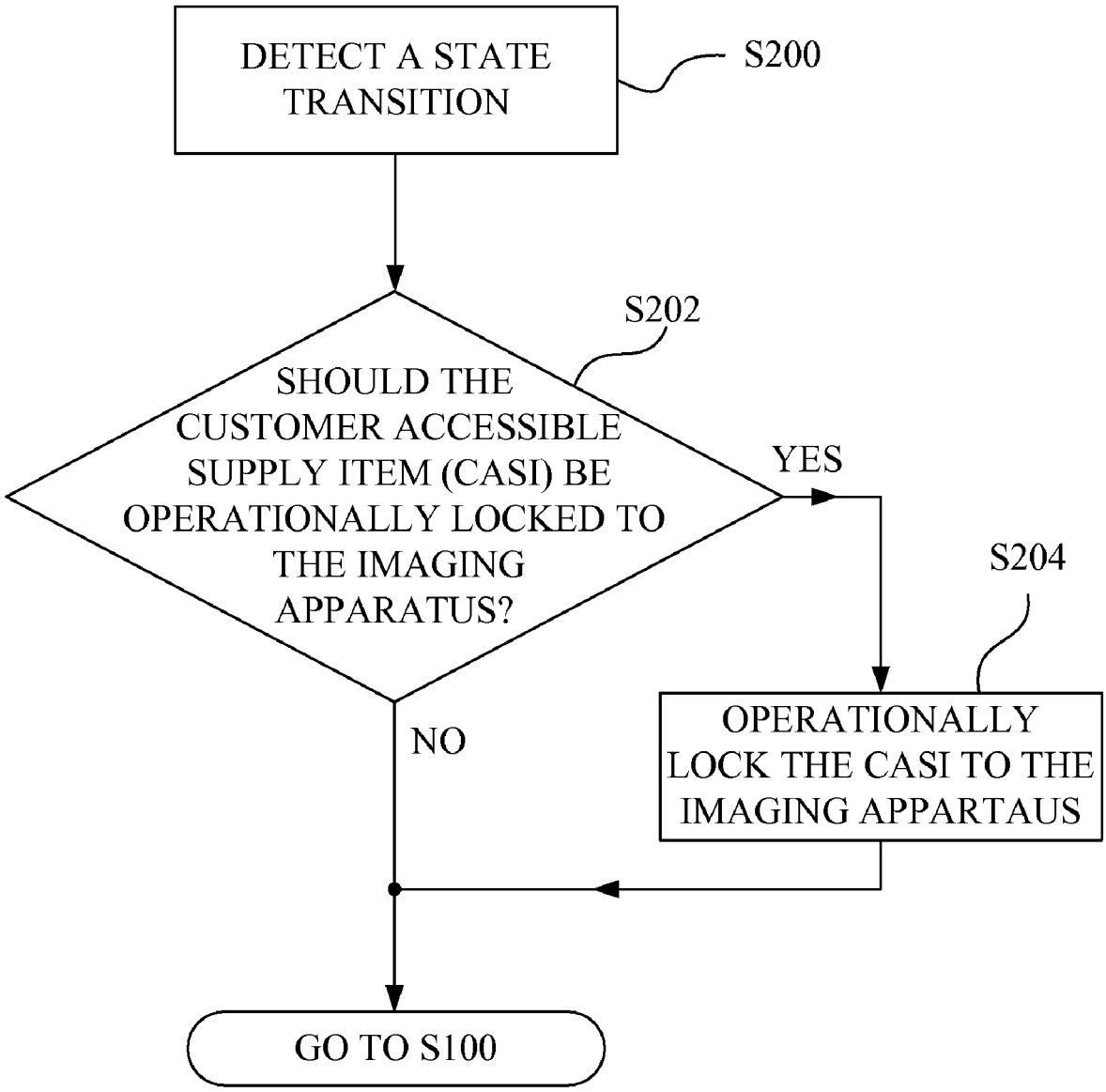

FIGS. 3 and 4 are flowcharts depicting of a method for associating a customer accessible supply item of a first type, e.g., customer accessible supply item 36, with an imaging apparatus, such as imaging apparatus 12, in accordance with an embodiment of the present invention. Customer accessible supply items may be of various types. One type, for example, is a "shipped-with" supply item that is installed in the imaging apparatus for distribution to a customer, e.g., shipped from a manufacturer or distributor. Another type, for example, is a replacement supply item intended for use with the imaging apparatus after initial distribution of the imaging apparatus to the customer, which is used to replace, for example, the shipped-with supply item.

At S100, it is determined whether a predefined event has occurred. The predefined event may be, for example, a power-on reset of imaging apparatus 12, or the closing of a cover, e.g., an access panel, of imaging apparatus 12.

If such a predefined event has occurred, at S102 it is determined whether imaging apparatus 12 is ready for customer usage.

If the determination at S102 is NO, then the process proceeds to S104, wherein the customer accessible supply item 36, e.g., a shipped-with type, installed in, or intended to be installed in, imaging apparatus 12 is operationally unlocked from the imaging apparatus. This state is present during manufacturing operations, or in a development model not intended for customer sale. As used herein, the term "operationally unlocked", and variations thereof, means that an exclusive union of customer accessible supply item 36 of the first type, e.g., a shipped-with type, with imaging apparatus 12 is undone, e.g., for test purposes, and occurs only at the place of manufacture or by a designated representative of the manufacturer. Also, for example, the manufacturer may set up the imaging apparatus, e.g., assign and store manufacturing defaults, in a manner such that a customer cannot accidentally change them, and/or perform diagnostics, etc.

Accordingly, in the present embodiment, S104 will not be executed by unauthorized personnel, i.e., S104 is performed while imaging apparatus 12 is in the possession of, for example, the imaging apparatus manufacturer or designated representative.

If the determination at S102 is YES, then the process proceeds to S106.

At S106, it is determined whether imaging apparatus 12 operationally accepts the customer accessible supply item 36 that is installed therein. The term "operationally accept", and variations thereof, means that the use of the customer accessible supply item (CASI) that is currently installed in the imaging apparatus is permissible. Act S106 may be performed when the imaging apparatus with the installed customer accessible supply item is in the possession of the customer, or when the imaging apparatus with the installed customer accessible supply item is in the possession of the manufacturer or designated representative.

In making the determination at S106, one or more tests may be performed. For example, the following tests may be performed: a customer accessible supply item 36 of a second type, e.g., an authorized replacement supply item, is present; a customer accessible supply item 36 of a first type, e.g., a shipped-with supply item, is operationally locked to imaging apparatus 12; imaging apparatus 12 is in a non-printing mode (e.g., a diagnostics mode, or similar); and a customer accessible supply item 36 of a first type, e.g., a shipped-with supply item, and imaging apparatus 12 are both operationally unlocked. If all of these tests fail then the currently installed customer accessible supply item 36 is not appropriate for printing operations.

The term "operationally locked", and variations thereof, means that an exclusive union of customer accessible supply item 36 of the first type, e.g., a shipped-with type, with imaging apparatus 12 has been established. This exclusive union may be, for example, a non-mechanical exclusive union implemented in memory and logic in controller 18 of imaging apparatus 12, in association with data stored in memory 40 of customer accessible supply item 36. Also, in some embodiments this exclusive union may be non-reversible by using non-rewritable memory, or if the memory is locked from further changes.

In general, during the test of whether customer accessible supply item 36 of a first type, e.g., a shipped-with supply item, is operationally locked to imaging apparatus 12, memory 40 of customer accessible supply item 36 of the first type and memory 32 of imaging apparatus 12 are interrogated, e.g., by controller 18, each time the imaging apparatus 12 undergoes the predefined event detected at S100 to assure a match between the relevant contents of memory 40 of customer accessible supply item 36 of the first type and the relevant contents of memory 32 of imaging apparatus 12. Such a match is an indication that customer accessible supply item 36 of the first type is operationally locked with imaging apparatus 12, when processed by the control logic of controller 18 of imaging apparatus 12 or similar imaging apparatuses.

If the determination at S106 is NO, then at S108 an error is declared. When memory 40 of customer accessible supply item 36 of the first type and memory 32 of imaging apparatus 12 are interrogated, if it is discovered that the installed customer accessible supply item has been locked to a different imaging apparatus, an error may be declared that the installed customer accessible supply item is not compatible with imaging apparatus 12. This may occur even if imaging apparatus 12 has never been locked to a customer accessible supply item of the first type. In either of these cases, the customer accessible supply item of the first type, e.g., a shipped-with imaging cartridge, may be returned to its respective original imaging apparatus to clear these errors.

The customer may be advised of the error, for example, by an error message displayed at user interface 22 of imaging apparatus 12, or at host 14. The error message may be general, or specific, in nature, and may include instructions to the user as to how to correct the error, such as for example, to install a customer accessible supply item 36 of a second type, e.g., an authorized replacement supply item, or to install the appropriate customer accessible supply item 36 of the first type, e.g., a shipped-with supply item. Specific errors may lead to different messages being displayed to aid in problem diagnosis.

The flowchart of FIG. 4 depicts the process of operationally locking customer accessible supply item 36 of the first type with imaging apparatus 12.

The process begins at S200, wherein it is detected that a state transition has occurred. This is optional, and in some embodiments may be eliminated. The detected state transition may be, for example, a determination that a particular threshold usage level of customer accessible supply item 36 has been reached. For example, if customer accessible supply item 36 of the first type is an imaging supply item, such as a toner cartridge, then the state transition may be an indication of "toner low".

Other alternative state transitions include, for example, a threshold page count being reached, a threshold toner depletion level being reached, a time during the manufacturing process, at an early stage of use of imaging apparatus 12, or near the end of the useful life of the customer accessible supply item 36 of the first type.

At S202, it is determined whether a particular customer accessible supply item 36 of the first type installed in imaging apparatus 12 should be operationally locked to imaging apparatus 12.

In the present embodiment, a determination of YES at act S202 indicates that customer accessible supply item 36 of the first type installed in imaging apparatus 12 should be operationally locked to imaging apparatus 12. The determination of YES may be made, for example, if the following conditions are satisfied: imaging apparatus 12 is designated, e.g., in memory 32, as being ready for customer usage; a customer accessible supply item 36 of the first type is installed in imaging apparatus 12; the predefined locations in memory 40, e.g., NVRAM, of customer accessible supply item 36 of the first type that is installed in imaging apparatus 12 does not indicate that customer accessible supply item 36 is operationally locked to any imaging apparatus; and imaging apparatus 12 is in a normal operating mode, e.g., a normal printing mode versus a diagnostics mode.

If any of these conditions are not satisfied, then customer accessible supply item 36 is not available to be operationally locked to imaging apparatus 12, i.e., the determination at S202 is NO, and the process returns to act S100 of FIG. 3.

With the YES determination at S202, the process proceeds to S204. S204 describes an exemplary process by which customer accessible supply item 36 of the first type, e.g., a shipped-with supply item, is operationally locked to imaging apparatus 12.

In one embodiment, for example, the act of operationally locking is facilitated by configuring imaging apparatus 12 to only operationally accept customer accessible supply item 36 of the first type with which a non-mechanical exclusive union is formed.

In the present embodiment, customer accessible supply item 36 of the first type, e.g., a shipped-with supply item, is operationally locked to imaging apparatus 12, to the exclusion of other customer accessible supply items of the first type, when identification information communicated between customer accessible supply item 36 of the first type and imaging apparatus 12 are deemed a valid match. This determination of a valid match may be achieved in a variety of ways.

Assume in this example that customer accessible supply item 36 of the first type may have supply item, e.g., cartridge, identification information stored in memory 40. The cartridge identification information stored in memory 40 is read by controller 18 of imaging apparatus 12 and stored in the predefined locations in memory 32, e.g., NVRAM, to indicate that customer accessible supply item 36 of the first type is operationally locked to a single imaging apparatus, e.g., imaging apparatus 12. This exchange of identification information establishes a non-mechanical exclusive union of customer accessible supply item 36 of the first type with imaging apparatus 12.

Controller 18 then executes program instructions to verify the match. For example, if at the predefined event at S100, the supply item identification information stored in memory 32 of imaging apparatus 12 does not correspond to the identity of the currently installed customer accessible supply item of the first type in imaging apparatus 12, then the error is declared at S108. However, if the supply item identification information stored in memory 32 of imaging apparatus 12 does correspond to the identity of the currently installed customer accessible supply item in imaging apparatus 12, then the currently installed customer accessible supply item is deemed to be locked to imaging apparatus 12 and normal operation of imaging apparatus 12 may continue.

As another example, assume that memory 32 of imaging apparatus 12 has stored therein imaging apparatus identification information. The imaging apparatus identification information stored in memory 32 is read by controller 18 of imaging apparatus 12 and stored in the predefined locations in memory 40, e.g., NVRAM, of customer accessible supply item 36 of the first type to indicate that customer accessible supply item 36 of the first type is operationally locked to a single imaging apparatus, e.g., imaging apparatus 12. This exchange of identification information establishes a non-mechanical exclusive union of customer accessible supply item 36 of the first type with imaging apparatus 12. Controller 18 then executes program instructions to verify the match, as described above.

As still another example, at the same time that the supply item information is stored in memory 32 of imaging apparatus 12, data is changed in memory 40 of customer accessible supply item 36 to indicate that it has been locked to a single imaging apparatus. For example, imaging cartridge information may be copied to printer memory, and the printer information, such as a serial number, may be copied to the cartridge being locked. Also, the cartridge identification information may be matched with a specific NVRAM location in the printer, e.g., imaging apparatus 12, regardless of which slot location in the printer that the imaging cartridge is installed. In this manner, locked imaging cartridges may be used in any color order in the printer, if desired.

Those skilled in the art will recognize that the present invention may be easily adapted to accommodate a variety of customer accessible supply items of various different types, for example, by performing the above described method for each type of customer accessible supply item. For example, if there were multiple imaging cartridges or other supplies, then an indication may be established in memory 32 of imaging apparatus 12 for each supply item in imaging apparatus 12 to indicate that imaging apparatus 12 has been locked to the associated supply item.

The foregoing description of several methods and an embodiment of the invention has been presented for purposes of illustration. It is not intended to be exhaustive or to limit the invention to the precise steps and/or forms disclosed, and obviously many modifications and variations are possible in light of the above teaching. It is intended that the scope of the invention be defined by the claims appended hereto.

What is claimed is:

1. A method for associating a customer accessible supply item of a first type with an imaging apparatus, comprising:

communicating identification information between said customer accessible supply item of said first type and said imaging apparatus; and operationally locking said customer accessible supply item of said first type with only said imaging apparatus based on said identification information, to the exclusion of other imaging apparatuses and other customer accessible supply items of said first type, wherein said customer accessible supply item of said first type is a supply item type that is shipped with said imaging apparatus for distribution to a customer, and wherein the act of operationally locking said customer accessible supply item of said first type with said imaging apparatus occurs when a usage of said customer accessible supply item of said first type has reached a predefined threshold.

2. The method of claim 1, wherein the act of operationally locking is a non-mechanical exclusive union of said customer accessible supply item of said first type with said imaging apparatus.

3. The method of claim 2, wherein said non-mechanical exclusive union is non-reversible by unauthorized personnel.

4. The method of claim 1, wherein said customer accessible supply item of said first type is an imaging cartridge.

5. The method of claim 1, wherein the act of operationally locking is facilitated by configuring said imaging apparatus to only operationally accept said customer accessible supply item of said first type with which a non-mechanical exclusive union is formed.

6. The method of claim 1, further comprising detecting a state transition that initiates a determination of whether said customer accessible supply item of said first type should be operationally locked with said imaging apparatus.

7. The method of claim 6, wherein said state transition occurs after a predetermined usage of said customer accessible supply item of said first type.

8. The method of claim 1, wherein if either of said imaging apparatus and said customer accessible supply item of said first type is already operationally locked to another device, then the act of operationally locking is not performed.

9. The method of claim 1, wherein the act of operationally locking occurs only after a customer has possession of said imaging apparatus and said customer accessible supply item of said first type.

10. The method of claim 1, wherein said imaging apparatus has a first memory and said customer accessible supply item of said first type has a second memory having stored therein supply item identification information, the act of operationally locking including:

storing said supply item identification information in said first memory of said imaging apparatus; and at a predefined event, declaring an error condition if said supply item identification information stored in said first memory of said imaging apparatus does not correspond to a currently installed customer accessible supply item of said first type in said imaging apparatus.

11. The method of claim 1, wherein said imaging apparatus has a first memory having stored therein imaging apparatus identification information and said customer accessible supply item of said first type has a second memory, the act of operationally locking including:

storing data in said second memory of said customer accessible supply item of said first type to indicate said customer accessible supply item of said first type is operationally locked to a single imaging apparatus; and at a predefined event, declaring an error condition if said data in said second memory of said customer accessible supply item of said first type does not correspond to a current imaging apparatus in which said customer accessible supply item of said first type is installed.

12. A method for associating a customer accessible supply item of a first type with an imaging apparatus, comprising:

communicating identification information between said customer accessible supply item of said first type and said imaging apparatus; and determining whether said customer accessible supply item of said first type is operationally locked with said imaging apparatus based on an interrogation of said identification information, wherein the state of being operationally locked is a non-mechanical exclusive union of said customer accessible supply item of said first type with said imaging apparatus, wherein said customer accessible supply item of said first type is a supply item type that is shipped with said imaging apparatus for distribution to a customer, and wherein said customer accessible supply item of said first type is operationally locked with said imaging apparatus when a usage of said customer accessible supply item of said first type has reached a predefined threshold.

13. The method of claim 12, wherein said imaging apparatus has a first memory having stored therein supply item identification information corresponding to a particular customer accessible supply item of said first type, and wherein the act of determining includes:

interrogating said supply item identification information stored in said first memory of said imaging apparatus and a current supply item identification information associated with a currently installed customer accessible supply item of said first type; and at a predefined event, if said supply item identification information stored in said first memory of said imaging apparatus does not correspond to said current supply item identification information associated with said currently installed customer accessible supply item of said first type, then declaring an error condition.

14. The method of claim 12, wherein imaging apparatus identification information associated with a particular imaging apparatus is stored in a memory of said customer accessible supply item of said first type, and wherein the act of determining includes:

interrogating said imaging apparatus identification information stored in said memory of said customer accessible supply item of said first type and interrogating a current imaging apparatus identification information of a current imaging apparatus in which said customer accessible supply item of said first type is installed; and at a predefined event, if said imaging apparatus identification information stored in said memory of said customer accessible supply item of said first type does not correspond to said current imaging apparatus identification information of said current imaging apparatus, then declaring an error condition.

15. The method of claim 12, wherein said customer accessible supply item of said first type is a supply item type that is shipped with said imaging apparatus for distribution to a customer.

16. The method of claim 12, wherein said customer accessible supply item of said first type is an imaging cartridge.

17. A method for associating a customer accessible supply item of a first type with an imaging apparatus, wherein said imaging apparatus has a first memory having stored therein imaging apparatus identification information and said customer accessible supply item of said first type has a second memory having stored therein supply item identification information, comprising operationally locking said customer accessible supply item of said first type with only said imaging apparatus based on said imaging apparatus identification information and said supply item identification information, wherein a state of being operationally locked is a non-mechanical exclusive union of said customer accessible supply item of said first type with said imaging apparatus, wherein said customer accessible supply item of said first type is a supply item type that is shipped with said imaging apparatus for distribution to a customer, and wherein the act of operationally locking said customer accessible supply item of said first type with said imaging apparatus occurs when a usage of said customer accessible supply item of said first type has reached a predefined threshold.

18. The method of claim 17, wherein said customer accessible supply item of said first type is a supply item type that is shipped with said imaging apparatus for distribution to a customer.

* * * * *